US005196727A

United States Patent [19]

Isozumi et al.

[11] Patent Number: 5,196,727

[45] Date of Patent: Mar. 23, 1993

[54] COAXIAL ENGINE STARTER

[75] Inventors: Shuzoo Isozumi; Shigeru Shiroyama; Akira Morishita, all of Himeji, Japan

[73] Assignee: Mitsubishi Denki Kabushiki Kaisha, Tokyo, Japan

[21] Appl. No.: 811,667

[22] Filed: Dec. 23, 1991

Related U.S. Application Data

[63] Continuation-in-part of Ser. No. 484,968, Feb. 26, 1990, abandoned.

[30] Foreign Application Priority Data

Feb. 27, 1989 [JP] Japan ..... 1-47526

[51] Int. Cl.[5] ..... F02N 11/00; F02N 15/06

[52] U.S. Cl. ..... 290/48; 74/7 R; 74/7 E; 290/38 R; 290/38 A; 290/386; 310/179

[58] Field of Search ..... 74/7 R, 7 E; 290/38 R, 290/38 A, 38 C, 48; 310/179

[56] References Cited

U.S. PATENT DOCUMENTS

| | | | |
|---|---|---|---|
| 30,272 | 10/1860 | Vergnes | 310/179 |
| 1,435,101 | 11/1922 | Brisbois | 74/9 |
| 3,090,880 | 5/1963 | Raymond | 310/179 |
| 4,942,323 | 7/1990 | DeCesare | 310/179 |

FOREIGN PATENT DOCUMENTS

| | | |
|---|---|---|
| 277566 | 8/1988 | European Pat. Off. . |
| 2310009 | 11/1976 | France . |

OTHER PUBLICATIONS

European Search Report.

Bosch Technische Unterrichtung VDT-U1/11, p. 28 and English translation thereof.

Bosch Technische Unterrichtung VDT-B6/3, pp. 3, 12, 15, 19 and its English translation.

*Primary Examiner*—A. D. Pellinen

*Assistant Examiner*—Robert L. Hoover

*Attorney, Agent, or Firm*—Sughrue, Mion, Zinn, Macpeak and Seas

[57] ABSTRACT

A coaxial engine starter comprises an electric motor having an armature winding of a single turn and a hollow armature rotary shaft for generating a rotational force for starting an engine. The starter also comprises an over-running clutch mechanism disposed within the hollow armature rotary shaft for preventing the occurrence of an excessive-speed of the armature and having a pinion having a gear teeth number equal to or less than seven for engaging with a ring gear of an engine upon starting of the electric motor. A solenoid switch is also disposed behind the electric motor for moving a pinion shaft forward and supplying an electric power to the electric motor.

7 Claims, 2 Drawing Sheets

COAXIAL ENGINE STARTER

This is a continuation-in-part of application Ser. No. 07/484,968 filed Feb. 26, 1990, abandoned.

BACKGROUND OF THE INVENTION

This invention relates to a coaxial engine starter for use with automotive engines.

FIG. 1 is a sectional view illustrating a conventional coaxial starter such as that disclosed in Japanese Patent Laid-Open No. 63-192962. As shown in FIG. 1, the coaxial starter includes an armature 1 of a d.c. electric motor, an armature core 2, and a hollow armature rotary shaft 3 having formed inside thereof a wedge-shaped cam surface 3*a* for providing an over-running clutch function. The armature core is press-fit onto the outer circumference of the armature rotary shaft 3.

Reference numeral 4 designates a commutator of the face type mounted at the rear outer circumference of the rotary shaft 3. The surface against which brushes 5 contact and slide for commutation is defined by a surface perpendicular to the rotary shaft 3. The commutator 4 is connected to an armature coil 6 wound on the core 2.

The brush 5 is urged forward by a spring 5*a* disposed at its rear side so that the tip of the brush 5 is brought into contact under pressure onto the sliding surface of the commutator 4.

Reference numeral 7 indicates permanent magnets mounted at the inner circumference of the yoke 8 defining a magnetic circuit for generating a magnetic field in the armature 1. The rear end of the yoke 8 is fitted onto the rear bracket 9 and the front end of the yoke 8 is fitted onto the front bracket 10.

Reference numeral 11 indicates a bearing fitted onto the rear end of the rotary shaft 3 and supported by the rear bracket 9. The rear bracket 9 has formed in the outer circumferential flange portion of the recess for accommodating the bearing 11 thereof a plurality of openings corresponding in position and in number to the brushes 5.

Reference numeral 12 designates a plastic brush holder which houses therein the brush 5 and the spring 5*a* and has stationary contacts 13 for connection to an unillustrated terminal insert-molded at its rear portion, the stationary contacts 13 having secured thereto, by a screw 15, a terminal 14 on which a lead wire 5*b* of the positive side brush 5 is welded.

Reference numeral 16 designates rollers disposed on the cam 3*a* formed in the inner surface of the rotary shaft 3, providing an over-running function together with roller springs.

Reference numeral 17 designates a clutch inner member of the over-running clutch mechanism having a bearing 18 mounted on the outer circumference of the middle portion thereof to support the front end of the rotary shaft 3.

Reference numeral 19 indicates a bearing mounted within the front bracket 10 and supports the front end of the clutch inner member 17.

Reference numeral 17*a* indicates helical splines formed in the inner surface of the clutch inner member 17, the helical splines 17*a* engaging the helical splines 20*c* formed in the outer circumference of the middle portion of a pinion shaft 20 having a pinion 20*a* at its front end and a flange 20*b* for dust and water resistance.

Reference numeral 21 indicates a stopper mounted on the rear portion of the pinion shaft 20, and 22 indicates a bearing for supporting the rear portion of the pinion shaft 20 mounted in the inner surface of the clutch inner member 17, the bearing 22 supporting the front end of a return spring 23 of the pinion shaft 20.

The pinion shaft 20 is moved forward along the axis while compressing the spring 23 by the stopper 21 until the stopper 21 abuts against the rear end face 17*b* of the clutch inner member 17 at which the forward movement is completed.

Reference numeral 24 indicates a solenoid switch attached to the rear bracket 9 by bolts 25, the solenoid switch has a function of forwardly moving the pinion shaft 20 and a switching function for turning on the contacts to allow the power supply from the battery to the electric motor upon the closure of the key switch.

Reference numeral 26 indicates a movable assembly for pushing the pinion shaft 20 from the behind it and having a movable contact 28 supported by insulators 27*a* and 27*b*.

Reference numeral 26*a* indicates a plunger, 26*b* a rod, 26*c* a second holder, 26*d* a first holder secured between the plunger 26*a* and the rod 26*b* and having mounted thereon the movable contact 28 and the like. The rod 26*b* is secured to the plunger 26*a* by caulking its rear end on the rear surface of the plunger 26*a*.

Reference numeral 29 indicates a spring for urging the pinion shaft 20, the spring 29 being disposed at the outer circumference of the rod 26*b* between the first holder 26*d* and the second holder 26*c*.

Reference numeral 30 indicates a third holder which urges the pinion shaft 20 by a compression spring 31.

Reference numeral 32 indicates a steel ball disposed between the front end of the third holder 30 and a recessed portion of the rear end of the pinion shaft 20 and having a function of supporting a thrust force.

Reference numeral 33 indicates an excitation coil wound on the bobbin 33*a* of a plastic material for energizing the plunger 26*a*. Reference numerals 34*a* and 34*b* denote a rear core and a front core, respectively, constituting together with a case 35 a magnetic circuit.

Reference numeral 36 indicates a plate of a nonmagnetic material, which is a rear wall of the solenoid switch 24 serving as a stopper for the plunger 26*a* when it is rearwardly returned.

Reference numeral 37 indicates a packing disposed between the case 35 and the plate 36 and having a water resisting function.

Reference numeral 38 indicates a spring disposed between the plunger 26*a* and the front core 34*b* for returning the movable assembly 26 to its home position when the key switch is turned off.

Reference numeral 39 is a through bolt connecting the rear bracket 9 and the front bracket 10.

It will be apparent to those of ordinary skill in the art that the arrangement of the coaxial starter illustrated in FIG. 1 is a sectional view and that the construction details are repeated about the centerline of the starter defined by shaft 3. For example, a plurality of coils comprising armature coil 6 are disposed about the armature 1.

The operation will now be described. First, for the state in which a key switch is off, the excitation coil 33 is not excited because it is in the non-conductive state, and since only the spring force of the spring 38 acts on the plunger 26*a*, the movable assembly 26 is positioned at the rear portion and the plunger 26a is brought into abutment with the plate 36.

In this state, the stationary contact 13 and the movable contact 28 are in the separated state, so that the electric motor is stopped and the pinion shaft 20 is also located at the rear portion by the spring 23 and stand still with the rear surface of the flange 20b brought into abutment with the front surface of the clutch inner member 17.

When the key switch is turned on, the excitation coil 33 is energized to actuate the plunger 26a, causing the movable assembly 26 to move forward and the movable contact 28 to be brought into contact with the stationary contact 13.

Therefore, the armature coil 6 is energized through the brush 5 and the commutator 4 thereby to start the electric motor.

On the other hand, the pinion shaft 20 is pushed forward by the springs 29, 31 of the movable assembly 26, whereby the pinion 20a is brought into engagement with the ring gear formed around a fly wheel of an engine at the same time the d.c. motor is started.

Immediately after the starting of the engine, the pinion shaft 20 and the clutch inner member 17 are moved together with the ring gear due to the uni-directional over-running function, idling relative to the armature 1.

When the key switch is turned off when the starting has been completed, the electrical power is disconnected, the movable assembly 26 rearwardly returns due to the function of the spring 38 within the solenoid switch 24, and the pinion shaft 20 rearwardly returns by the function of the spring 23.

Since the conventional coaxial starter is constructed as above described, the minimum number of teeth of the pinion is eight, and with such a starter, each coil of the armature coil 6 has generally two turns in order to obtain requisite torque as the d.c. motor, making it difficult to make the outer diameter of the rotary shaft 3 large, so that the assembly of the over-running clutch within the rotary shaft 3 is difficult and disadvantageous in performance because it is necessary to use small-diameter long rollers or a plurality of small-diameter rollers axially arranged in series.

SUMMARY OF THE INVENTION

Accordingly, one object of the present invention is to provide a coaxial engine starter free from the above-discussed problems.

Another object of the present invention is to provide a coaxial engine starter in which the requisite d.c. motor torque is ensured.

Another object of the present invention is to provide a coaxial engine starter in which the over-running clutch can be easily assembled and which has a superior performance.

With the pinion according to the present invention, the number of the teeth of the pinion is made equal to or less than seven, thereby making the gear ratio between the engine ring gear and the pinion greater than that of pinion having the teeth number of eight which is the smallest number in the conventional design, a sufficient torque can be obtained even with a single turn armature winding, and by making each armature winding a single-turn coil, the outer diameter of the rotary shaft can be made large, improving the ease of assembly of the over-running clutch within the rotary shaft.

BRIEF DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENT

Figure 1:
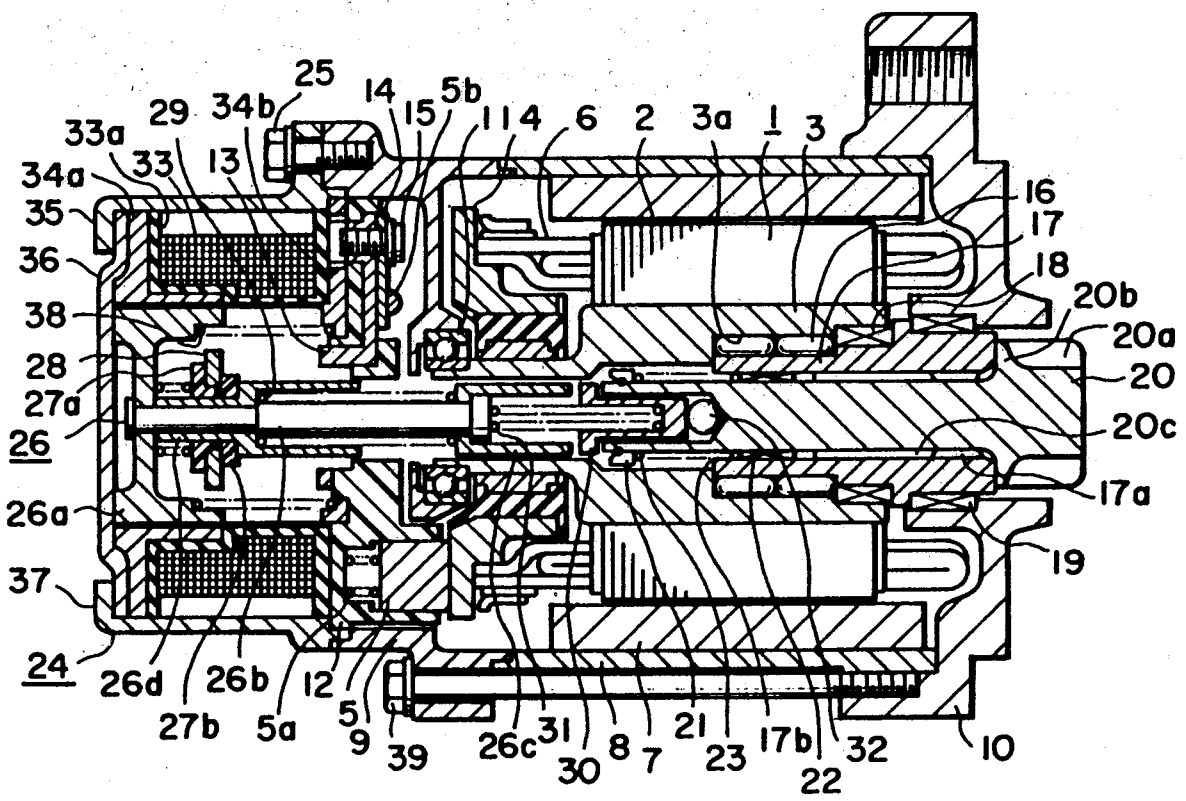
FIG. 1 PRIOR ART
FIG. 1 is a sectional view of the conventional coaxial engine starter.
Figure 2:
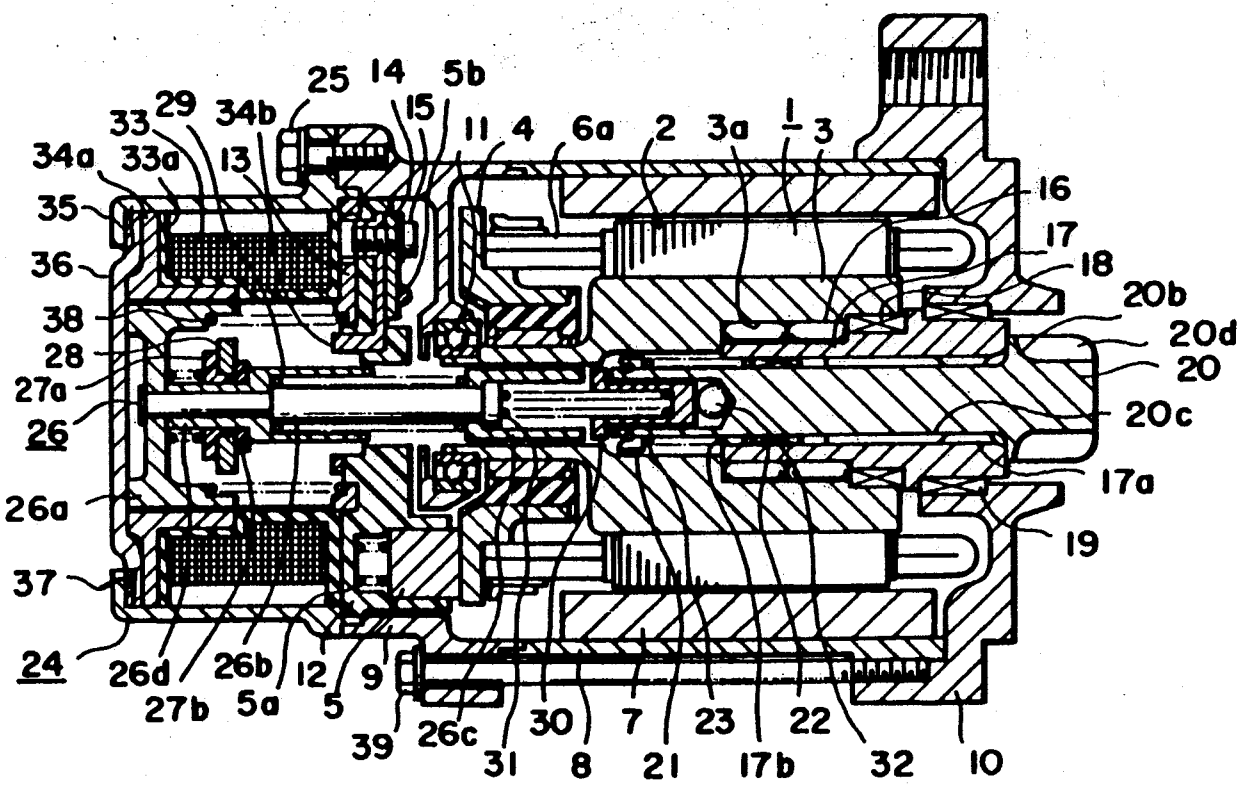
FIG. 2 is a sectional view of the coaxial engine starter of one embodiment of the present invention.

In FIG. 2, the same reference numerals used in FIG. 1 designate the same components. Reference numeral 1 designates an armature of a d.c. electric motor, 2 an armature core, and 3 designates a hollow armature rotary shaft having formed inside thereof a wedge-shaped cam surface 3a for providing a function of an over-running clutch, and the armature core 2 is press-fit onto the outer circumference of the armature rotary shaft 3.

Reference numeral 4 designates a commutator of the face type mounted at the rear outer circumference of the rotary shaft 3, the surface against which brushes 5 contact and slide for commutation is defined by a surface perpendicular to the rotary shaft 3. The commutator 4 is connected to an armature coil 6a wound on the core 2.

According to the present invention, the armature coil 6a is characterized by a single turn coil. It will be apparent that a plurality of coils comprising armature coil 6a are evenly distributed about the circumference of armature 1. It should also be noted that coaxial starter motors employing an armature coil formed from single turn coils do not produce excessive or hazardous armature currents. Those of ordinary skill in the art will appreciate that the conductor comprising each single turn armature coil is a small diameter wire and that each of the coils is located in a closely spaced slot so as to maintain a high armature resistance, which prevents the single turn coils from acting as a short circuit when voltage is applied to each coil. Thus, it will be understood during the following discussion that references made to a single turn coil define the characteristics of each of the coils comprising armature coil 6a located about the circumference of armature 1.

The brush 5 is urged forward by a spring 5a disposed at its rear side so that the tip of the brush 5 is brought into contact under pressure onto the sliding surface of the commutator 4.

Reference numeral 7 indicates permanent magnets mounted at the inner circumference of the yoke 8 defining a magnetic circuit for generating a magnetic field in the armature 1. The rear end of the yoke 8 is fitted onto the rear bracket 9 and the front end of the yoke 8 is fitted onto the front bracket 10.

Reference numeral 11 indicates a bearing fitted onto the rear end of the rotary shaft 3 and is supported by the rear bracket 9. The rear bracket 9 has formed in the outer circumferential flange portion of the recess for accommodating the bearing 11 thereof a plurality of openings corresponding in position and in number to the brushes 5.

Reference numeral 12 designates a plastic brush holder which houses therein the brush 5 and the spring 5a and has stationary contacts 13 for connection to an unillustrated terminal insert-molded at its rear portion, the stationary contacts 13 having secured thereto, by a screw 15, a terminal 14 on which a lead wire 5b of the positive side brush 5 is welded.

Reference numeral 16 designates rollers disposed on the cam 3a formed in the inner surface of the rotary shaft 3, providing an over-running function together with roller springs.

Reference numeral 17 designates a clutch inner member of the over-running clutch mechanism having a bearing 18 mounted on the outer circumference of the middle portion thereof to support the front end of the rotary shaft 3.

Reference numeral 19 indicates a bearing mounted within the front bracket 10 and supports the front end of the clutch inner member 17.

Reference numeral 17a indicates helical splines formed in the inner surface of the clutch inner member 17, the helical splines 17a engaging the helical splines 20c formed in the outer circumference of the middle portion of a pinion shaft 20 having a pinion 20d at its front end and a flange 20b for dust and water resistance.

According to the present invention, the number of gear teeth of the pinion 20d is equal to or less than seven.

Reference numeral 21 indicates a stopper mounted on the rear portion of the pinion shaft 20, and 22 indicates a bearing for supporting the rear portion of the pinion shaft 20 mounted in the inner surface of the clutch inner member 17, the bearing 22 supporting the front end of a return spring 23 of the pinion shaft 20.

The pinion shaft 20 is moved forward along the axis while compressing the spring 23 by the stopper 21 until the stopper 21 abuts against the rear end face 17b of the clutch inner member 17 at which the forward movement is completed.

Reference numeral 24 indicates a solenoid switch attached to the rear bracket 9 by bolts 25, the solenoid switch has a function of forwardly moving the pinion shaft 20 and a switching function for turning on the contacts to allow the power supply from the battery to the electric motor upon the closure of the key switch.

Reference numeral 26 indicates a movable assembly for pushing the pinion shaft 20 from behind it and having a movable contact 28 supported by insulators 27a and 27b.

Reference numeral 26a indicates a plunger, reference numeral 26b denotes a rod, reference numeral 26c identifies a second holder and reference numeral 26d indicates a first holder secured between the plunger 26a and the rod 26b and having mounted thereon the movable contact 28 and the like.

The rod 26b is secured to the plunger 26a by caulking its rear end on the rear surface of the plunger 26a. Reference number 29 indicates a spring for urging the pinion shaft 20, the spring 29 being disposed at the outer circumference of the rod 26b between the first holder 26d and the second holder 26c.

Reference numeral 30 indicates a third holder which urges the pinion shaft 20 by a compression spring 31.

Reference numeral 32 indicates a steel ball disposed between the front end of the third holder 30 and a recessed portion of the rear end of the pinion shaft 20 and having a function of supporting a thrust force.

Reference numeral 33 indicates an excitation coil wound on the bobbin 33a of a plastic material for energizing the plunger 26a. Reference numbers 34a and 34b denote a rear core and a front core, respectively, constituting together with a case 35 a magnetic circuit.

Reference numeral 36 indicates a plate of a nonmagnetic material, which is a rear wall of the solenoid switch 24 serving as a stopper for the plunger 26a when it is rearwardly returned.

Reference numeral 37 indicates a packing disposed between the case 35 and the plate 36 and having a water resisting function.

Reference numeral 38 indicates a spring disposed between the plunger 26a and the front core 34b for returning the movable assembly 26 to its home position when the key switch is turned off.

Reference numeral 39 is a through bolt connecting the rear bracket 9 and the front bracket 10.

The operation will now be described. First, in the state in which the key switch is off, the excitation coil 33 is not excited because it is in the non-conductive state, and since only the spring force of the spring 38 acts on the plunger 26a, the movable assembly 26 is positioned at the rear portion and the plunger 26a is brought into abutment with the plate 36.

In this state, the stationary contact 13 and the movable contact 28 are in the separated state, so that the electric motor is stopped and the pinion shaft 20 is also located at the rear portion by the spring 23 and stand still with the rear surface of the flange 20b brought into abutment with the front surface of the clutch inner member 17.

When the key switch is turned on, the excitation coil 33 is energized to actuate the plunger 26a, causing the movable assembly 26 to move forward until the movable contact 28 engages the stationary contact 13.

Therefore, armature coil 6a is energized through the brush 5 and the commutator 4 thereby to start the electric motor.

On the other hand, the pinion shaft 20 is pushed forward by the springs 29, 31 of the movable assembly 26, whereby the pinion 20d is brought into engagement with the ring gear formed around a fly wheel of an engine at the same time the d.c. motor is started.

Immediately after the starting of the engine, the pinion shaft 20 and the clutch inner member 17 are moved together with the ring gear due to the uni-directional over-running function, idling relative to the armature 1.

When the key switch is turned off after the starting has been completed, the electrical power is disconnected, the movable assembly 26 rearwardly returns due to the function of the spring 38 within the solenoid switch 24, and the pinion shaft 20 rearwardly returns by the function of the spring 23.

While the face-type commutator is employed as the commutator 4 in the above embodiment, a commutator of another type may equally be used.

Also, while the permanent magnet 7 is used for generating a motor magnetic field, this may be replaced with a magnetic pole with a coil wound on it.

Also, although the pinion shaft 20 and the pinion 20d are made integral, the pinion 20d may be spline-engaged with the pinion shaft 20 and mounted by a stopper.

Although the rotary shaft 3 is used as the clutch outer member of the over-running clutch, the over-running clutch may be fitted over or press-fir onto the rotary shaft 3.

Further, while the above embodiment has been described as having the pinion shaft including pinion gear teeth in the inside of the clutch inner member of the over-running clutch, the pinion gear teeth and the shaft may be separate members, and any arrangement for transmitting power between the pinion and the clutch inner member of the over-running clutch can be employed.

Moreover, in the above description, although the size of the teeth of the pinion or the module is not discussed, the smaller module is preferred from the view point of overall engine arrangement because the engine ring gear need not be made large-sized, and the present invention is effective when applied to a pinion having a module equal to or less than 2.75. Also, the greater pressure angle of the gear is preferred because the number of teeth can be made as small as possible, the preferable pressure angle being equal to or larger than 14.5° and the more preferred pressure angle being equal to or larger than 20°.

As has been described, according to the present invention, the number of the pinion gear teeth is equal to or less than seven and the armature winding has a single turn, so that the diameter of the rotary shaft can be made large and the assembly is easy, providing advantages that a high-quality, high-performance coaxial starter.

What is claimed is:

1. A coaxial engine starter comprising:

an electric motor having an armature winding characterized in that each coil of said armature winding is a single turn armature coil and a hollow armature rotary shaft for generating a rotational force for starting an engine;

an over-running clutch mechanism disposed within said hollow armature rotary shaft for preventing the occurrence of an excessive-speed of said armature and having a pinion having a gear teeth number equal to or less than seven for engaging with a ring gear of an engine upon starting of said electric motor; and a solenoid switch disposed behind said electric motor for moving a pinion shaft forward and supplying electric power to said electric motor.

2. A coaxial engine starter for providing a rotational force greater than or equal to a requisite torque for starting an engine having an engine ring gear, comprising:

an electric motor for providing a d.c. motor torque, said electric motor having a hollow armature rotary shaft and an armature winding characterized in that each coil of said armature winding is a single turn armature coil;

an over-running clutch mechanism disposed within said hollow armature rotary shaft for preventing the occurrence of an excessive speed of said armature and having a pinion for engaging with the ring gear of the engine upon starting of said electric motor, said pinion and said ring gear having a predetermined module; and a solenoid switch disposed behind said electric motor for moving a pinion shaft coupled to said pinion forward and providing power to said electric motor so as to produce said d.c motor torque, said d.c. motor torque being transmitted between said pinion and the ring gear and being increased by said predetermined module to thereby produce the rotational force greater than or equal to the requisite torque so as to rotate the engine.

3. The coaxial motor starter of claim 2, wherein said predetermined module is less than or equal to about 2.75.

4. The coaxial motor starter of claim 2, wherein said pinion further comprises a predetermined number of teeth having a predetermined pressure angle between said teeth and the ring gear.

5. The coaxial motor starter of claim 4, wherein said predetermined number of teeth of said pinion is less than eight.

6. The coaxial motor starter of claim 4, wherein said predetermined pressure angle is greater than or equal to about 14.5°.

7. The coaxial motor starter of claim 4, wherein said predetermined pressure angle is greater than or equal to about 20°.

* * * * *